US008769970B2

(12) United States Patent
Fung et al.

(10) Patent No.: US 8,769,970 B2
(45) Date of Patent: Jul. 8, 2014

(54) REFRIGERATED CASE WITH REHEAT AND PRECONDITIONING

(75) Inventors: Kwok K. Fung, Granger, IN (US); Neelkanth S. Gupte, Katy, TX (US)

(73) Assignee: Hill Phoenix, Inc., Conyers, GA (US)

( * ) Notice: Subject to any disclaimer, the term of this patent is extended or adjusted under 35 U.S.C. 154(b) by 1330 days.

(21) Appl. No.: 12/089,446

(22) PCT Filed: Nov. 28, 2005

(86) PCT No.: PCT/US2005/043033
§ 371 (c)(1),
(2), (4) Date: Apr. 7, 2008

(87) PCT Pub. No.: WO2007/061420
PCT Pub. Date: May 31, 2007

(65) Prior Publication Data
US 2008/0271473 A1 Nov. 6, 2008

(51) Int. Cl.
*F25D 17/06* (2006.01)
*A47F 3/04* (2006.01)
*F25B 29/00* (2006.01)
*F25B 39/02* (2006.01)

(52) U.S. Cl.
USPC ..... 62/90; 62/93; 62/246; 62/173; 62/524

(58) Field of Classification Search
USPC ..... 62/90, 93, 246, 515–528, 173, 62/176.4–176.6; 165/181, 58, 61, 170, 165/150–153
See application file for complete search history.

(56) References Cited

U.S. PATENT DOCUMENTS

| | | | | | |
|---|---|---|---|---|---|
| 2,200,118 | A | * | 5/1940 | Miller | 62/173 |
| 2,822,672 | A | * | 2/1958 | Dickson et al. | 62/125 |
| 3,067,592 | A | | 12/1962 | McFarlan | |
| 3,499,295 | A | | 3/1970 | Brennan | |
| 3,572,052 | A | | 3/1971 | Toth | |
| 4,711,094 | A | | 12/1987 | Ares et al. | |
| 5,315,837 | A | | 5/1994 | Lego | |
| 5,333,470 | A | * | 8/1994 | Dinh | 62/333 |
| 5,666,813 | A | | 9/1997 | Brune | |
| 5,799,728 | A | | 9/1998 | Blume | |
| 5,983,998 | A | * | 11/1999 | Kim | 165/150 |

(Continued)

FOREIGN PATENT DOCUMENTS

WO WO 03/087683 * 10/2003 ..... F25B 29/00

OTHER PUBLICATIONS

PCT International Preliminary Report on Patentability relating to International Application No. PCT/US05/43033, date of completion of this report, Nov. 8, 2006 (3 pgs.).

(Continued)

*Primary Examiner* — Cassey D Bauer
(74) *Attorney, Agent, or Firm* — Foley & Lardner LLP

(57) ABSTRACT

A refrigerated case (20) has a housing containing an interior volume (36) for storing items. Along an air flow path (510) through the case, a refrigerant-to-air heat exchanger (60) has an evaporator section (112) and a reheat section (114). A preconditioning section (110) may be upstream of the evaporator section (112) and the evaporator section is upstream of the reheat section (114). Along a refrigerant flow path (520), the reheat section (114) is downstream of the preconditioning section (110) (if any) and upstream of the evaporator section (112) and an expansion device (62) is between the reheat (114) and evaporator (112) sections.

30 Claims, 7 Drawing Sheets

(56) References Cited

U.S. PATENT DOCUMENTS

| | | | | |
|---|---|---|---|---|
| 6,272,876 | B1 * | 8/2001 | Roberts et al. | 62/255 |
| 6,460,372 | B1 | 10/2002 | Fung et al. | |
| 6,701,723 | B1 * | 3/2004 | Dobmeier et al. | 62/90 |
| 6,705,093 | B1 | 3/2004 | Taras et al. | |
| 2004/0050539 | A1 * | 3/2004 | Bemisderfer | 165/151 |
| 2004/0123613 | A1 * | 7/2004 | Chiang et al. | 62/246 |
| 2004/0168456 | A1 * | 9/2004 | Chiang et al. | 62/246 |

OTHER PUBLICATIONS

PCT International Search Report relating to International Application No. PCT/US05/43033, date of mailing of the International Search Report, Apr. 20, 2006 (2 pgs.).

* cited by examiner

REFRIGERATED CASE WITH REHEAT AND PRECONDITIONING

BACKGROUND OF THE INVENTION

The invention relates to refrigerator cases. More particularly, the invention relates to coil configurations and routing in open-front cases.

Refrigerated cases (generically including both freezers and refrigerator-only units) are used in a variety of commercial situations. One key use is for retail display and vending. Many such cases include a closed rear wall and either an open front or a glass door front. U.S. Pat. No. 6,460,372, the disclosure of which is incorporated by reference herein as if set forth at length, discloses an exemplary open-front refrigerated case configuration.

Providing a forced air flow through the compartment of such cases is important for a number of reasons. Maintaining the desired food temperature in view of exposure to room air is an important factor. Moisture transport is another (e.g., to control undesirable condensation). One common forced flow scheme involves a cold air curtain downwardly discharged from a front top area of the compartment. A return flow is drawn through an intake at the bottom front of the compartment.

The return flow may be drawn across a cooling heat exchanger (e.g., evaporator coils), typically in a base of the case. The cooled air passes upward through a rear duct at the back of the compartment. The cooled air then passes forward through a top duct. at the front of the top duct, the air is turned downward by turning vanes to form the air curtain. The rear and top ducts may respectively be defined between rear and top insulated panels and non-insulated rear and top duct panels along the rear and top of the compartment.

SUMMARY OF THE INVENTION

One aspect of the invention involves a refrigerated case having a housing containing an interior volume for storing items. An air flow path extends from an air inlet to an air outlet. A fan is positioned to drive an air flow along the air flow path. The air outlet is positioned to discharge cold air to cool the interior volume. A refrigerant-to-air heat exchanger is positioned along the air flow path. A refrigerant flow path passes through the heat exchanger. An expansion device is located along the refrigerant flow path.

Along the air flow path, the heat exchanger has evaporator and reheat sections. A preconditioning section (if any) may be upstream of the evaporator section and the evaporator section is upstream of the reheat section.

Along the refrigerant flow path, the reheat section is downstream of the preconditioning section (if any) and upstream of the evaporator section and the expansion device is between the reheat and evaporator sections.

The details of one or more embodiments of the invention are set forth in the accompanying drawings and the description below. Other features, objects, and advantages of the invention will be apparent from the description and drawings, and from the claims.

BRIEF DESCRIPTION OF THE DRAWINGS

Like reference numbers and designations in the various drawings indicate like elements.

DETAILED DESCRIPTION

Figure 1:
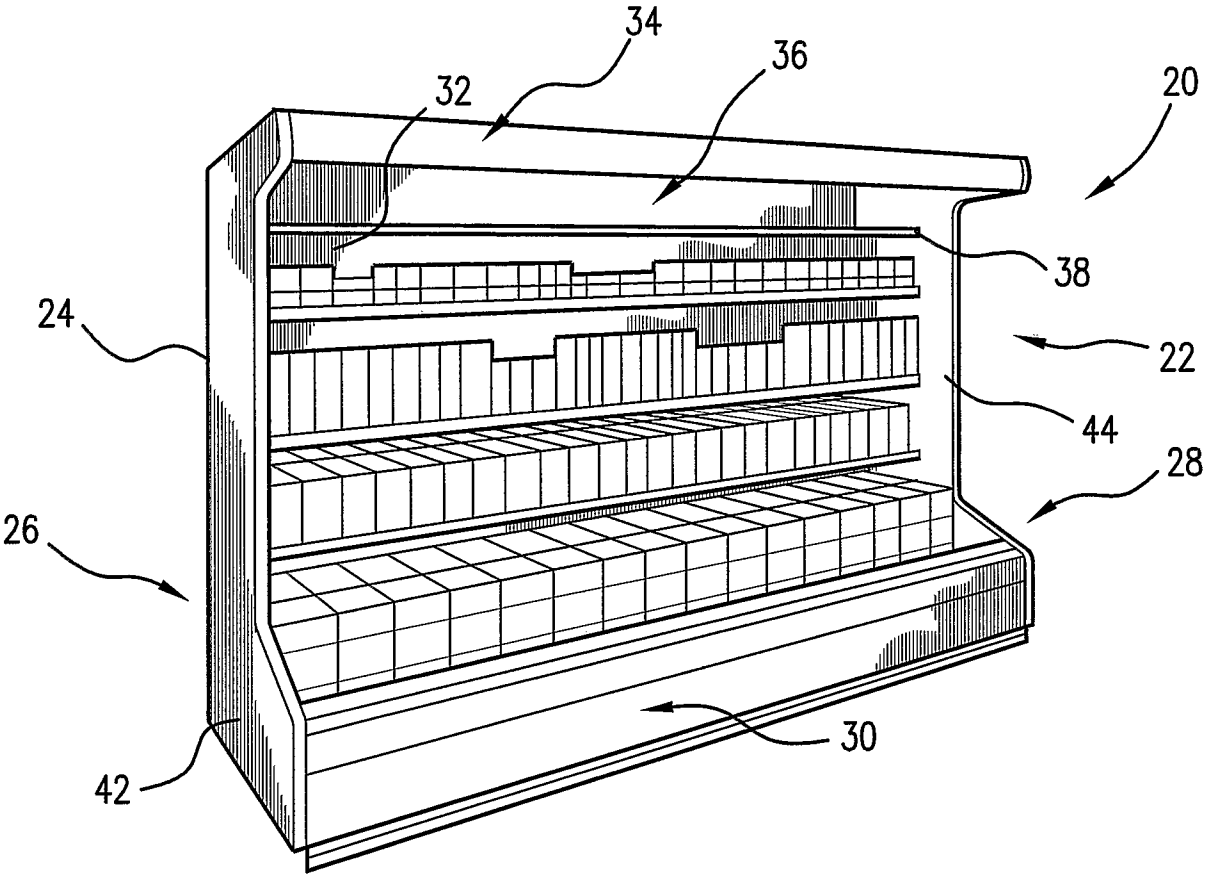
FIG. 1 is a view of an exemplary refrigerated case.

FIG. 1 shows a refrigerator case 20 having a front 22, a back 24, and right and left ends 26 and 28. For purposes of reference, front, back, left, and right, are taken from the point of view of the case itself rather than a user facing the case. The case includes housing having a base structure 30, a rear wall structure 32, and a top structure 34. The case has a cooled interior volume or compartment 36. The exemplary case has a series of vertical groups of shelves 38. The exemplary case is an open-front case. Alternatively, the case could be a closed case having a sliding or hinged glass door front structure. The exemplary case housing has patch end structures 42 and 44. Where cases are arrayed side-by-side, partitions (if any) may be used between cases within the array and patch ends may be used at the two ends of the array.

The exemplary base 30 may include front and back transverse rails or 50 and 52 for supporting the remainder of the base and, therethrough, the remainder of the case atop a ground/floor surface. The exemplary base 30 contains at least a portion of the refrigeration equipment (e.g., a heat exchanger 60 functioning in part as an evaporator and an expansion device 62, shown schematically in FIG. 2). The heat exchanger 60 may be connected to remote compressor 64 (e.g., in an equipment room) and condenser 66 (e.g., outside of a building, such as on the roof). Alternative implementations might feature a compressor and/or condenser within the housing or might feature a compressor and/or condenser associated with multiple cases.

Figure 2:
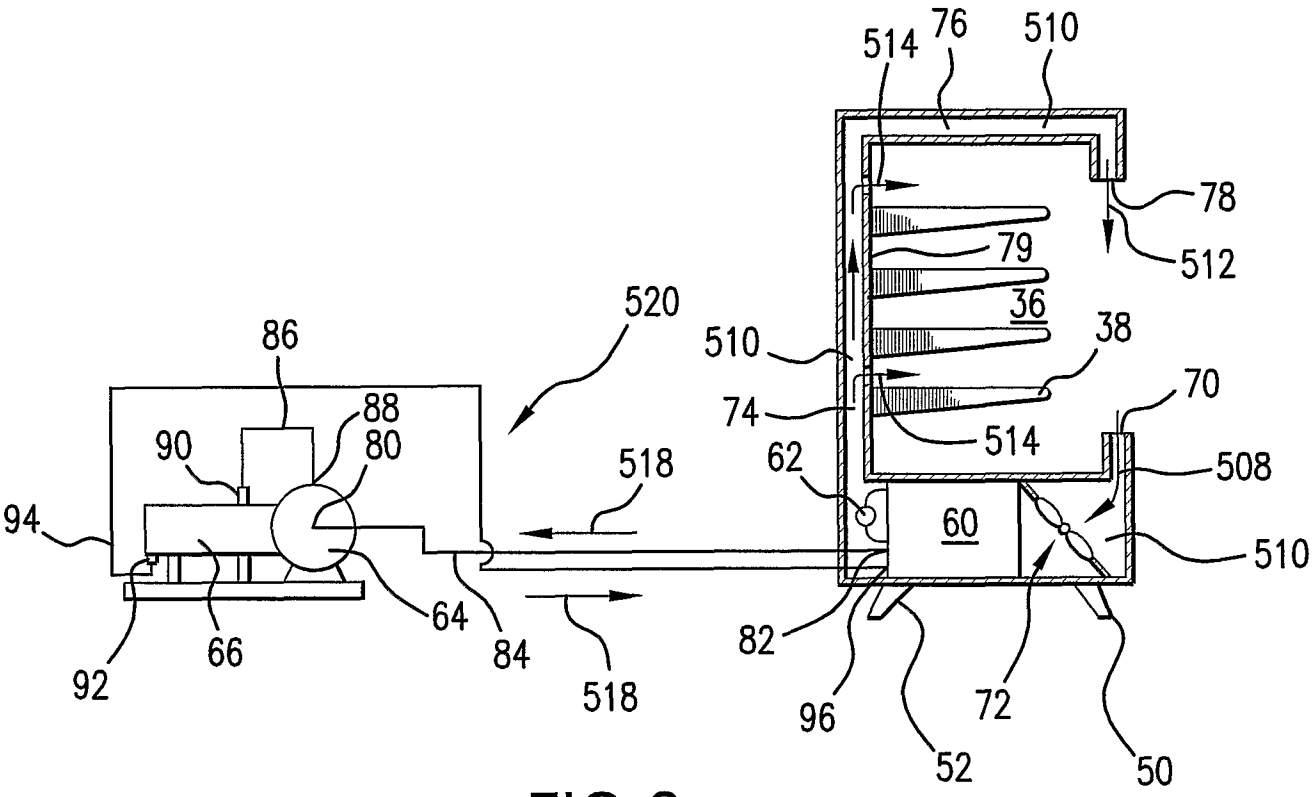
FIG. 2 is a schematic view of a refrigeration system of the case of FIG. 1.

FIG. 2 further schematically shows an air flow 508 along an air flow path 510 through the case. The air flow path 510 has an inlet 70 (e.g., at a grate near a forward top portion of the base). The air flow 508 along the flow path 510 may be driven by a fan 72 (e.g., shown in an upstream portion of the air flow path between the inlet 70 and the heat exchanger 60). As is discussed in further detail below, the inlet flow of air drawn in through the inlet 70 may include a return flow of air from the case interior volume 36 mixed with external room air.

The air flow passes through the heat exchanger 60 as is discussed in further detail below. After exiting the heat exchanger 60, the air flow passes upward through a rear section of the air flow path 510 in a duct 74. The air flow then proceeds forward through a top duct 76 and exits the top duct through an outlet 78 (e.g., a group of vanes or a honeycomb directing the outlet/discharge flow 512 downward along the front of the case). One or more branch air flows 514 may branch off (e.g., through apertures in the wall 79 of the duct 74).

FIG. 2 further schematically shows a refrigerant flow 518 along a refrigerant flow path 520 through the refrigeration equipment. Along the refrigerant flow path 520, the compressor 64 has an inlet port 80 receiving refrigerant from an outlet 82 of the heat exchanger 60 via a suction conduit/line 84. The compressor discharges refrigerant to a discharge conduit/line 86 through a compressor outlet 88. The discharge conduit 86 extends to an inlet port 90 of the condenser 66. The refrigerant is condensed into liquid in the condenser 66 and discharged through a condenser outlet 92 to a liquid conduit/line 94. The liquid conduit 94 delivers the refrigerant to an inlet 96 of the heat exchanger 60.

Figure 3:
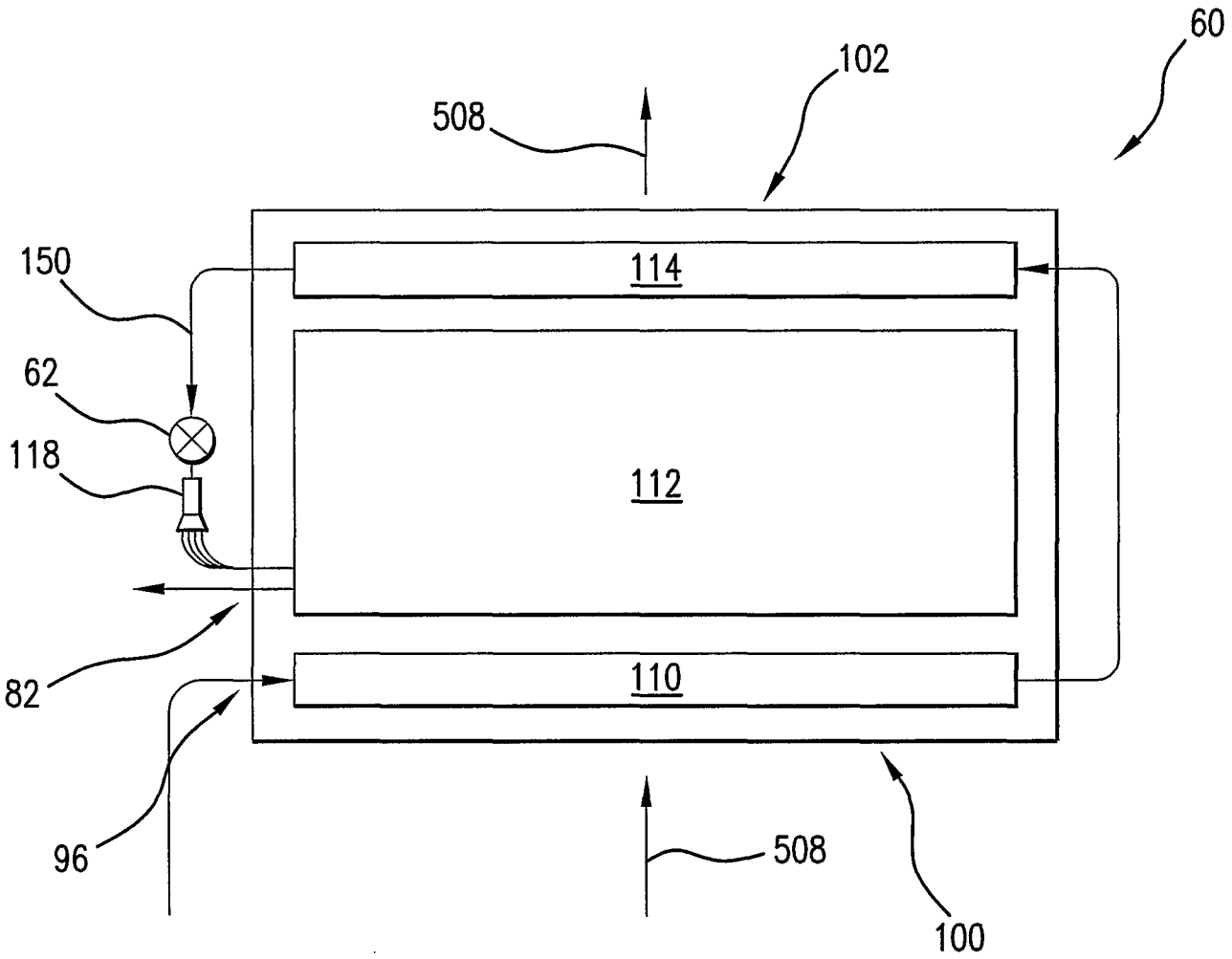
FIG. 3 is a top schematic view of a first heat exchanger of the system of FIG. 2.

FIG. 3 shows further details of the heat exchanger 60. Along the air flow path 510, the heat exchanger 60 has an upstream end 100 and a downstream end 102. From upstream to downstream along the air flow path 510, the heat exchanger 60 has a first section 110, a second section 112, and a third section 114.

The exemplary heat exchanger 60 is a refrigerant-to-air heat exchanger through which the refrigerant flow path 520 also passes. Along the refrigerant flow path 520, the first section 110 is also an upstream section, receiving the refrigerant flow 518 through the inlet 96. The first section 110 is, however, coupled to deliver the refrigerant flow to the third section 114 downstream thereof, bypassing the second section 112. Refrigerant exiting the third section 114 is expanded in the expansion device 62 (e.g., a thermal expansion valve (TXV)) then delivered to the second section 112 via a distribution manifold 118. Refrigerant exits the second section 112 through the outlet 82 to return to the compressor.

Accordingly, the heat exchanger second section 112 acts as an evaporator. The third section 114 serves as a reheat section operating in conjunction with the evaporator (e.g., s may play roles in moisture control.

Figure 4:
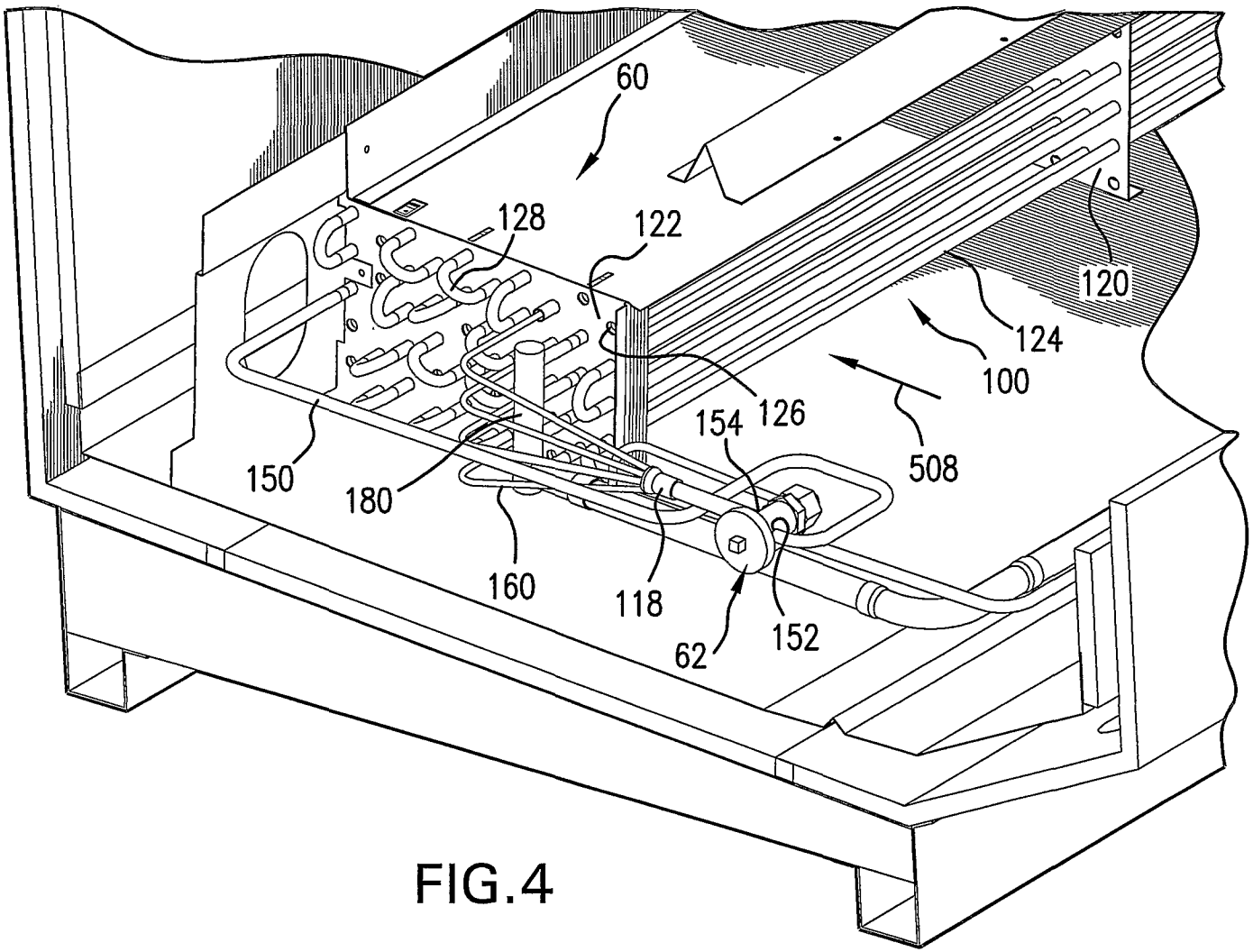
FIG. 4 is a view of the heat exchanger of FIG. 3.

FIG. 4 shows an exemplary construction of the heat exchanger 60. The heat exchanger 60 includes a left side plate 120 and a right side plate 122. A number of tubes 124 extend between the side plates. The exemplary tubes 124 extend through associated holes 126 in each of the side plates and have end portions protruding beyond the side plates. Along a given side plate, the end portions may be connected to each other by U-tubes 128 or to additional components. In the exemplary heat exchanger, the holes 126 are formed in a regular array. The tubes are therefore positioned along that array. However, some of the holes may be empty, there being no tubes in the associated positions in the array (discussed in further detail below).

Figure 5:
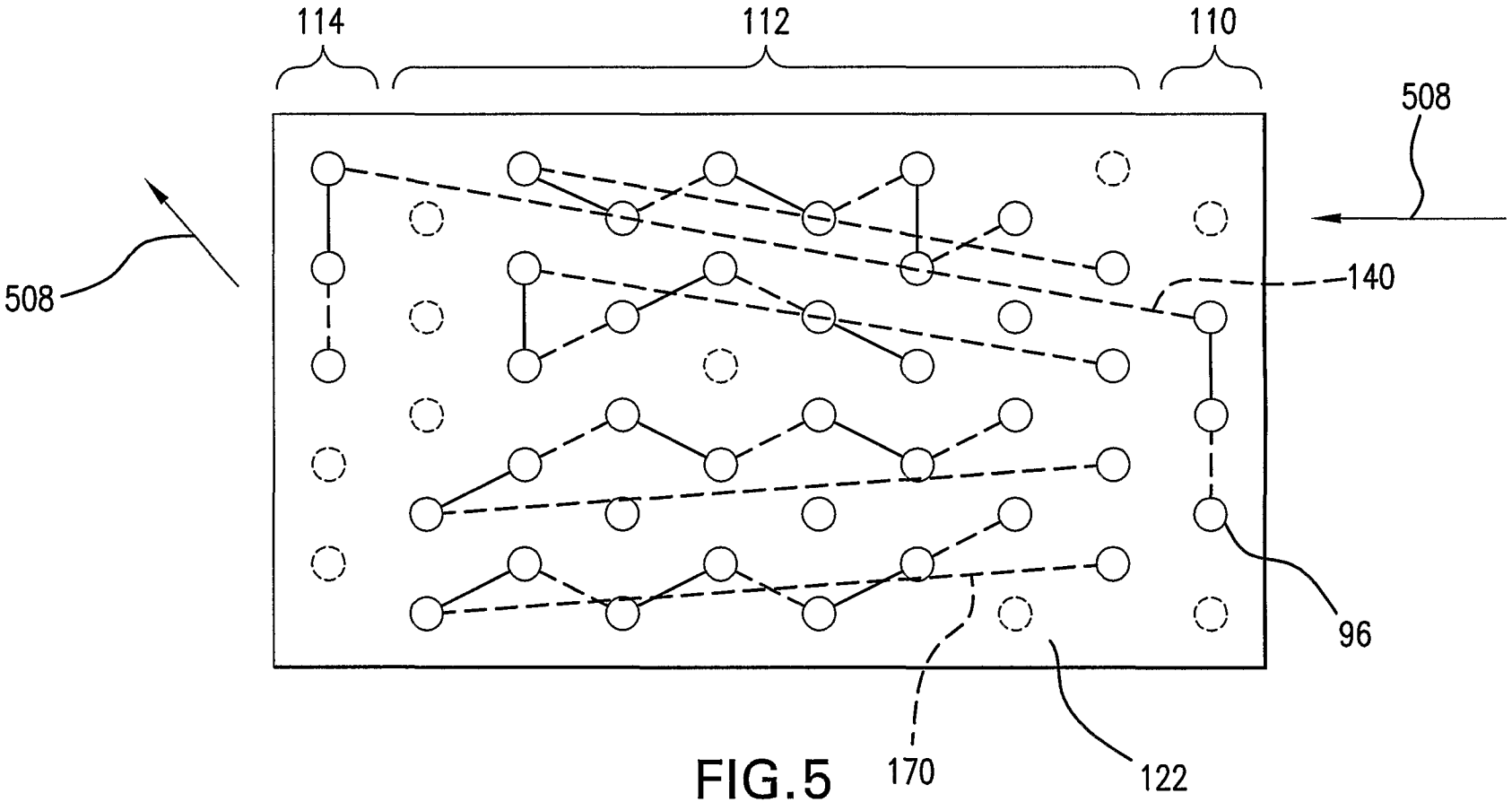
FIG. 5 is a first side schematic view of the heat exchanger of FIG. 3.
Figure 6:
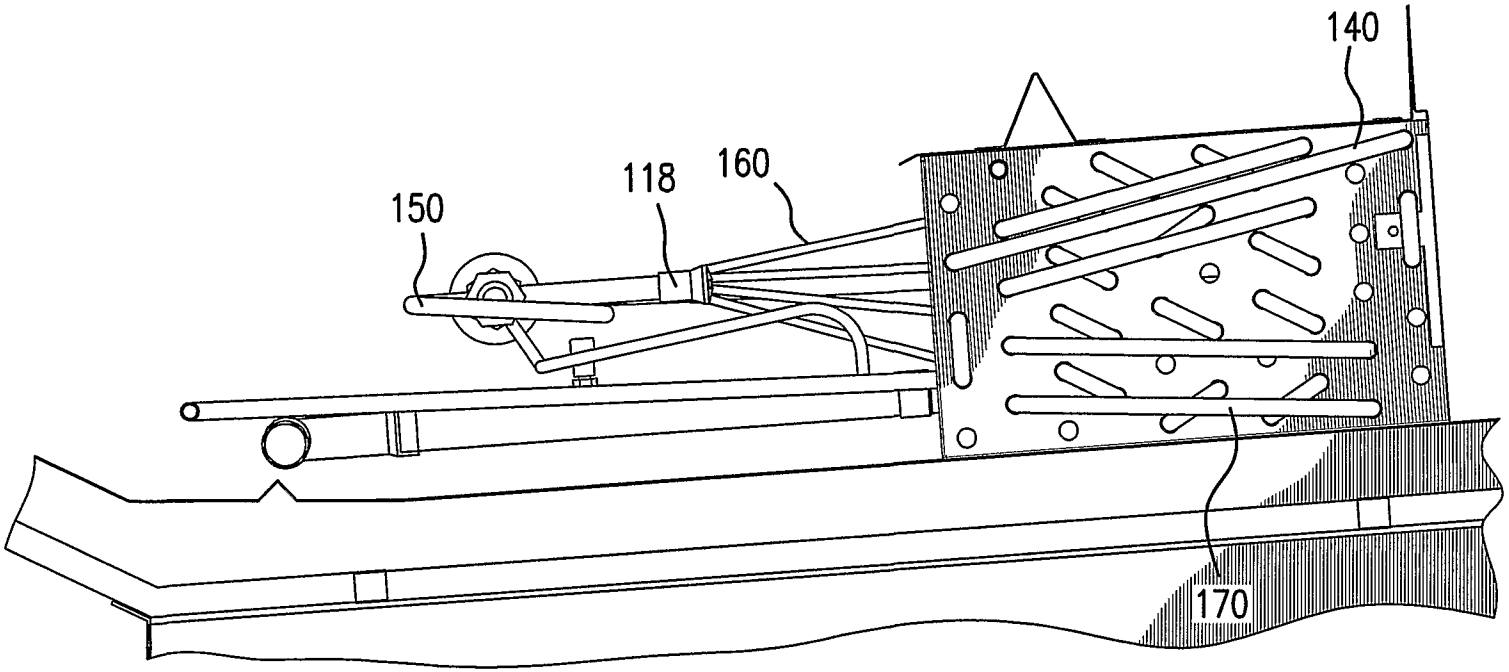
FIG. 6 is a first side view of the heat exchanger of FIG. 3.
Figure 7:
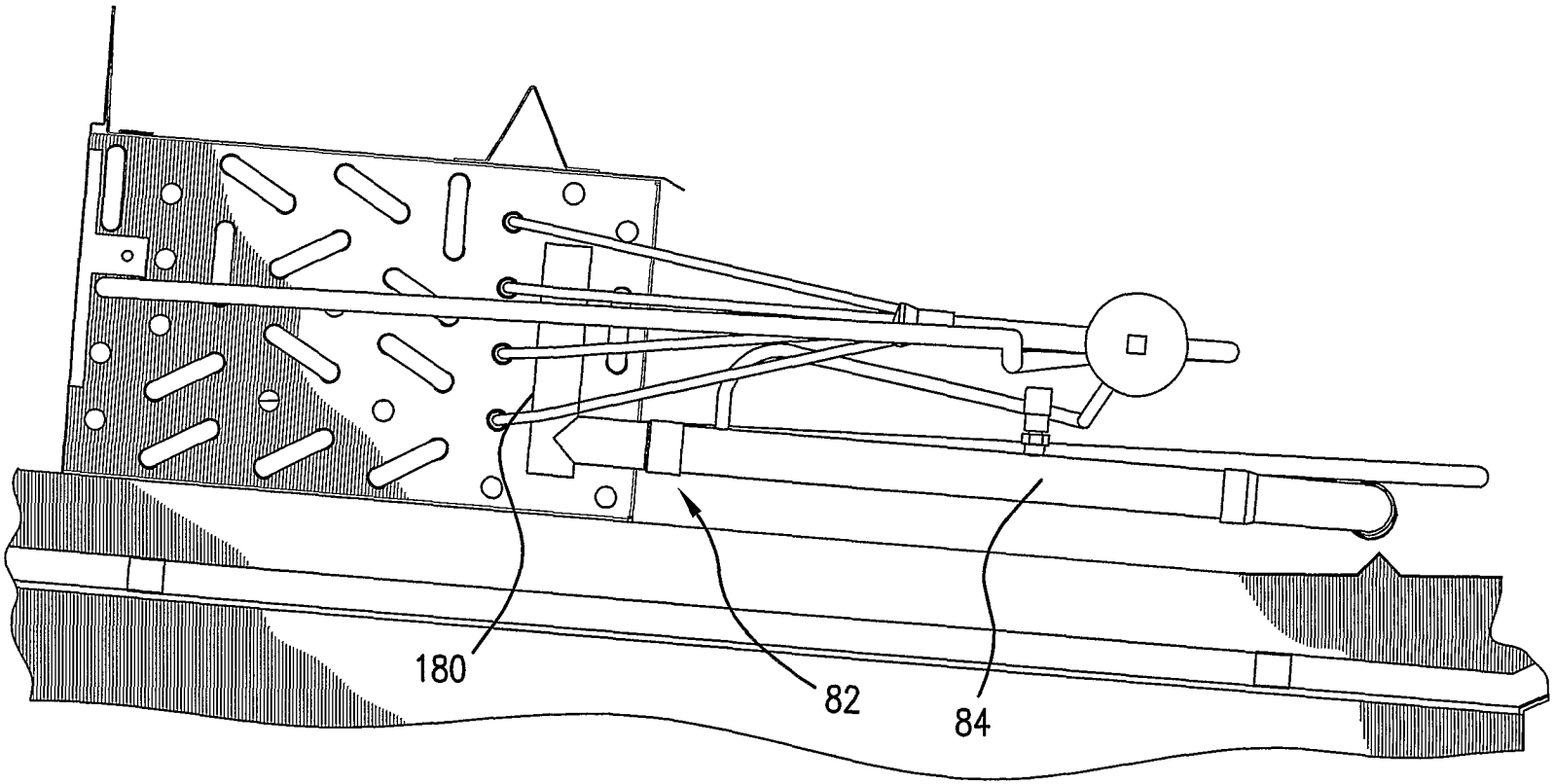
FIG. 7 is a second side view of the heat exchanger of FIG. 3.

FIG. 5 schematically shows the plumbing of the exemplary heat exchanger. FIG. 5 shows the right side plate 122 with the empty holes 126 shown as broken line circles to distinguish the remaining holes. Connections outboard of the right side plate 122 are shown in solid lines. Connections outboard of the left side plate are shown in broken line. The exemplary heat exchanger has an upstream-to-downstream array of ten groups of the holes 126 and tubes 124. The tubes of each group extend in a first transverse direction (e.g., near horizontally) and the groups extend in the other transverse direction (e.g., near vertically). In the exemplary heat exchanger, there are holes 126 to accommodate up to five tubes per group. In the exemplary heat exchanger, the holes of each group are evenly spaced exactly out-of-phase with the holes of the adjacent group(s).

In the exemplary heat exchanger, there are three tubes in the upstreammost (first/leading) group, in the three central positions. The inlet 96 is formed at one end (e.g., the right end) of one of these tubes (e.g., the lowest). The refrigerant flow in the first section 110 thus proceeds through this tube, then through one of the U-connectors 128 to the second tube immediately above and then through another of the U-connectors to the third tube yet above the second tube. The refrigerant flow then traverses through a long connector conduit/line ("jumper") 140 to the last group of tubes (the third section 114). In the exemplary heat exchanger, the connector 140 connects to one end (e.g., the left end) of one of the tubes (e.g., a tube in the uppermost of the five available positions) and then through one of the connectors 128 to the next tube therebelow and then through another of the connectors 128 to the tube therebelow. In the exemplary heat exchanger, the lower two tube positions in the downstreammost group are empty. This particular configuration was selected because the air flow exiting the heat exchanger is directed upward to pass through the rear duct 74. Accordingly, the air flow has the greatest exposure to tubes in the high positions of the downstreammost group. The refrigerant exiting the last tube in this final group then enters a conduit 150 (FIG. 4) and is directed to an inlet 152 of the expansion device 62. Expanded refrigerant exiting the outlet 154 of the expansion device 62 is directed through the manifold 118 and then through a plurality of conduits 160. In the exemplary heat exchanger, each of the conduits 160 feeds a right end of an associated tube of the third group of tubes (the second group of the section 112). In the exemplary heat exchanger, there are four such conduits 160 feeding tubes in the top four of the positions in the group (the bottommost position being vacant). In a somewhat zigzag fashion, each of the tubes successively feeds an additional associated sequence of tubes of some or all of the remaining groups in the second section 112. After feeding a downstreammost tube in each of these sequences, the refrigerant returns through an associated jumper conduit 170 to an associated tube of the second group (the first group of the second section 112). After passing through this last (in the refrigerant flow path) group of tubes, the refrigerant enters a common suction manifold 180 (FIG. 4) to provide the outlet 82 feeding the suction line 84. A basic version of such an evaporator layout/operation is disclosed in U.S. Pat. No. 6,460,372.

Although a basic dehumidification function may be achieved by use of pre-expansion refrigerant in the third section 114, alone, use of the first section 110 may have one or more of several advantages.

A given refrigerated case or model thereof may experience a wide range of ambient temperature conditions. A given case will experience seasonal changes, shorter term weather variations, daily temperature fluctuations and factors relating to siting within a particular store. More broadly, a given model may have to accommodate a wide variety of geographic locations, thereby exacerbating the required range of accommodation.

For an air cooled condensing unit, the condensing temperature and drop leg liquid refrigerant temperature is affected by the outdoor air temperature and system design. It is common that liquid refrigerant temperature enter the housing at 20-90° F.

For a medium temperature merchandiser operation, return air feeding into the heat exchanger is typically 38-46° F. depending on store ambient temperature, merchandise loading condition, and display configuration (e.g., peg bar, shelf etc.). After exchanging heat with refrigerant in the evaporator, air exiting a typical evaporator is typically 29-34° F. (depending on average coil temperature and system dynamic). The air temperature typically increases by 1-2° F. before discharge from the outlet 78.

For dairy, deli, beverage, and produce application, a discharge air temperature of 33-36° F. is common to keep products at the desired temperature.

In an exemplary summer condition without the first section 110, relatively warm (e.g., ~90° F.) liquid refrigerant enters the reheat section of the coil directly. Thus there is a large temperature difference (~60° F.) between the liquid refrigerant and the air exiting the evaporator (low 30's° F.). With high coil efficiency, after exchanging heat with the liquid refrigerant, the dry bulb temperature of air exiting the reheat section can increase by as much as 3° F. above that of the air exiting the evaporator. The relative humidity will drop from 99% to 78%. However, the temperature of air exiting the outlet can rise above acceptable range in some operating condition. And there might be an issue with product temperature.

With the first section 110, the warm (e.g., ~90° F.) liquid refrigerant enters the first section and exchanges heat with return air (e.g., at ~43° F.). The temperature of the liquid refrigerant will drop substantially (e.g., to ~46° F.) after passing sequentially through the three tubes of the first section 110. This cooled liquid refrigerant is then fed into the third (reheat) section 114 of the heat exchanger by the jumper conduit 140. The refrigerant then exchanges heat with the air exiting the evaporator 112 (at low 30's° F.), raising the air dry bulb by 1-2° F. (depending on location). This reduces the air relative humidity from 99% exiting the evaporator 112 to a range of ~90-95% exiting the reheat section 114. This dehumidification is sufficient (e.g., to absorb any condensation due to defrost & temperature cycles, infiltration due to merchandise overloading or other reason) and also is still sufficiently cold.

In the exemplary third section 114, only the uppermost three tube locations are used and the flow starts in the upper most tube and proceeds downward. These two factors impose a reheat gradient across the airflow, with the most reheated air exiting the heat exchanger near the top. Due to flow stratification, it is this warmest air (and lowest relative humidity) that will pass into the case interior near the bottom of the rear duct. Because condensation is often worst near the bottom of prior art cases, this stratification directs the driest air to where it is most required.

In an exemplary winter condition without the first section 110, liquid refrigerant enters the reheat section of the heat exchanger at a very low temperature (e.g., in the low 20's° F., or as low as 0° F.). This temperature may be even lower than the temperature of the air exiting the evaporator (e.g., in the low 30's° F.) to encounter it. Instead of raising the dry bulb temperature of the air, the refrigerant will further cool the air and produce an exit air relative humidity slightly higher than that of the air exiting the evaporator.

With the first section 110, the very low temperature liquid refrigerant enters the first section where it encounters return air at an exemplary temperature of ~38° F. (low store ambient temperature resulting in a lower return air temperature than in the summer). In the first section, the liquid refrigerant temperature is then raised to ~37.4° F. and fed into the reheat section 114 of the heat exchanger by the jumper conduit 140. In the third section 114, the liquid refrigerant then exchanges heat with air exiting the evaporator section 112 (e.g., ~30° F.). The air dry bulb would be raised by ~0.6 F, lowering the air relative humidity from ~97.4% exiting the evaporator 112 (in winter, the relative humidity of the air exiting evaporator tends to be lower than in summer) to ~94.8% exiting the reheat section. In a variation, if the liquid refrigerant entered the heat exchanger at 25° F. air exiting the reheat section would have 94.2% relative humidity with the first section.

The general effect of the first section is to moderate the liquid refrigerant temperature of the third section (e.g. to a ~37-50° F. range instead of a ~0-90° F. range). All other things being equal, the addition of the first and third sections produces a discharge air temperature slightly higher than without. Air distribution optimization in the display case may compensate for the slightly higher air temperature so as to maintain the temperature of merchandise in an acceptable range. Alternative optimizations may involve coil resizing.

One or more embodiments of the present invention have been described. Nevertheless, it will be understood that various modifications may be made without departing from the spirit and scope of the invention. For example, the foregoing teachings may be applied in the reengineering of an existing case configuration. In such a reengineering, details of the existing configuration will influence or dictate details of any particular implementation. This may include open top cases and closed cases. Accordingly, other embodiments are within the scope of the following claims.

What is claimed is:

1. A refrigerated case comprising:

a housing containing an interior volume for storing items;

an air inlet;

an air flow path extending from the air inlet; a fan positioned to drive an air flow along the air flow path;

an air outlet along the air flow path positioned to discharge cold air to cool the interior volume;

a refrigerant-to-air heat exchanger disposed along the air flow path, and a refrigerant flow path having at least a portion that extends through the heat exchanger;

and an expansion device along the refrigerant flow path, wherein:

along the air flow path, the heat exchanger has a preconditioning section, an evaporator section, and a reheat section, the evaporator section downstream of the preconditioning section and upstream of the reheat section; and along the refrigerant flow path, the preconditioning section is upstream of the reheat section, and the reheat section is upstream of the evaporator section and the expansion device is downstream of the reheat section and upstream of the evaporator section; and in the reheat section the refrigerant flow path is defined by reheat tube sections that are disposed adjacent to the top of the heat exchanger with the refrigerant configured to flow from the preconditioning section to an upper most one of the reheat tube sections and then toward a lower most one of the reheat tube sections.

2. The case of claim 1 further comprising: a condenser.

3. The case of claim 1 wherein: the reheat section is positioned to receive liquid refrigerant.

4. The case of claim 1 wherein: the expansion device is a thermal expansion valve.

5. The case of claim 1 wherein: the case is open-front.

6. The case of claim 1 wherein: the heat exchanger comprises a tube and plate exchanger.

7. The case of claim 1 wherein: the heat exchanger consists essentially of a single tube and plate exchanger unit.

8. The case of claim 1 wherein: the preconditioning section preconditions refrigerant entering the reheat section.

9. The case of claim 1 wherein: the heat exchanger preconditioning, evaporator and reheat sections are of a single regularly positioned array of tube sections.

10. The case of claim 9 wherein: said array is an evenly spaced flow-wise array of evenly-spaced transverse groupings of said tubes.

11. The case of claim 9 wherein: a plurality of locations on a lower most region of the reheat section of said array are unused.

12. The case of claim 1 wherein along the air flow path: the preconditioning section is an upstream-most section; and the reheat section is a downstreammost section.

13. The case of claim 1 wherein: in the evaporator section, refrigerant flow is along a plurality of fluidly parallel path segments.

14. The case of claim 13 wherein: along the air flow path, each of the plurality of fluidly parallel path segments starts along an intermediate stage of the evaporator section, proceeds generally downstream and ends upstream of the intermediate stage.

15. The case of claim 1 further comprising: a compressor along the refrigerant flow path and external to the housing; and a condenser along the refrigerant flow path and external to the housing.

16. The case of claim 15 wherein: the compressor is along the refrigerant flow path of only the refrigerated case and no other refrigerated case.

17. A method for operating a refrigerated case comprising:

propelling an air flow along an air flow path from an inlet to an outlet;

passing the air through a refrigerant-air heat exchanger having preconditioning, evaporator and reheat sections along the air flow path;

passing refrigerant along a refrigerant flow path through the preconditioning section, then through an upper most tube disposed adjacent a top of the heat exchanger in the reheat section and then toward a lower most tube section in the reheat section, then through an expansion device, and then through the evaporator section.

18. The method of claim 17 wherein: the refrigerant is passed through the reheat section as a liquid.

19. The method of claim 17 wherein: the propelling of the air comprises propelling with a fan.

20. The method of claim 17 wherein: the propelling of the air draws air in through the inlet at a lower front end of an open refrigerated compartment; and the propelling of the air discharges the air at an upper front end of the compartment.

21. A refrigerated case comprising:

a housing containing an interior volume for storing items;

an air inlet; an air flow path extending from the air inlet;

a fan positioned to drive an air flow along the air flow path;

an air outlet along the air flow path positioned to discharge cold air to cool the interior volume;

an evaporator along the air flow path and along a refrigerant flow path;

an expansion device along the refrigerant flow path;

a reheating section along the air flow path and along the refrigerant flow path for reheating air exiting the evaporator to reduce a relative humidity thereof; and a preconditioning section for moderating a temperature of refrigerant in the reheating section in a winter mode and to cool the refrigerant in the reheating section in a summer mode;

wherein along the air flow path, the preconditioning section is upstream of the evaporator; and along the refrigerant flow path, the reheating section is downstream of the preconditioning section and upstream of the evaporator and the expansion device is downstream of the reheating section and upstream of the evaporator; and in the reheat section the refrigerant flow path is defined by reheat tube sections that are disposed adjacent to a top of the heat exchanger with the refrigerant configured to flow from the preconditioning section to an upper most one of the reheat tube sections and then toward a lower most one of the reheat tube sections.

22. The case of claim 21 wherein: the preconditioning section is configured to warm the refrigerant in a winter mode and cool the refrigerant in a summer mode.

23. A method for operating a refrigerated case comprising:

propelling an air flow along an air flow path through a refrigerant-air heat exchanger having in sequence preconditioning, evaporator, and reheat sections along the air flow path; and passing refrigerant along a refrigerant flow path in flow sequence through the preconditioning section, then through an upper most tube section in the reheat section and then toward a lower most tube in the reheat section, an expansion device, and the evaporator section of the heat exchanger.

24. The method of claim 23 wherein: in the evaporator section, refrigerant flow is along a plurality of fluidly parallel path segments.

25. The method of claim 24 wherein: along the air flow path, each of the plurality of fluidly parallel path segments starts along an intermediate stage of the evaporator section, proceeds generally downstream and ends upstream of the intermediate stage.

26. The method of claim 24 wherein: the air flow path is a main flow path and a plurality of branches extend through a rear duct wall downstream of the heat exchanger.

27. The method of claim 23 wherein: the preconditioning comprises warming the refrigerant in a winter mode and cooling the refrigerant in a summer mode.

28. A refrigerated case comprising:

a housing containing an interior volume for storing items;

an air inlet;

an air flow path extending from the air inlet; a fan positioned to drive an air flow along the air flow path;

an air outlet along the air flow path positioned to discharge cold air to cool the interior volume;

a refrigerant-to-air heat exchanger along the air flow path and a refrigerant flow path through the heat exchanger;

and an expansion device along the refrigerant flow path;

wherein along the air flow path, the heat exchanger has an evaporator section and a preconditioning section, the evaporator section downstream of the preconditioning section and along the refrigerant flow path, the preconditioning section is upstream of the evaporator section and the expansion device is downstream of the preconditioning section and upstream of the evaporator section; and a reheat section, wherein the refrigerant flow path in the reheat section is defined by reheat tube sections that are disposed proximate a top of the heat exchanger with the refrigerant configured to flow from the preconditioning section to an upper most one of the reheat tube sections and then toward a lower most one of the reheat tube sections.

29. The case of claim 28 wherein the preconditioning section is configured to warm the refrigerant in a winter mode and cool the refrigerant in a summer mode.

30. The case of claim 28 wherein the preconditioning section is formed from an array of parallel spaced tubes and includes two or more inlets and two or more outlets.

* * * * *